US006564678B1

(12) United States Patent
Wang

(10) Patent No.: US 6,564,678 B1
(45) Date of Patent: May 20, 2003

(54) COMBINATION OF TOOL KITS

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 0 days.

(21) Appl. No.: 10/058,014

(22) Filed: Jan. 29, 2002

(51) Int. Cl.[7] ..... B25F 1/04

(52) U.S. Cl. ..... 81/124.4; 81/440; 81/437; 7/138; 7/118

(58) Field of Search ..... 81/124.4, 124.5, 81/436–440, 489, 490, 488; 7/100, 118, 138, 151, 165, 168, 901

(56) References Cited

U.S. PATENT DOCUMENTS 5,442,982 A * 8/1995 Bell ..... 81/439
5,711,042 A * 1/1998 Chuang ..... 7/138
5,806,380 A * 9/1998 Wilsey ..... 81/3.09
5,920,935 A * 7/1999 Beck ..... 7/128
6,009,582 A * 1/2000 Harrison et al. ..... 7/118
6,047,619 A * 4/2000 Anderson et al. ..... 81/440
6,112,351 A * 9/2000 Hawkins et al. ..... 7/138
RE37,210 E * 6/2001 Chuang ..... 7/138
6,311,587 B1 * 11/2001 Johnson et al. ..... 81/177.4

* cited by examiner

*Primary Examiner*—Joseph J. Hail, III
*Assistant Examiner*—David B. Thomas
(74) *Attorney, Agent, or Firm*—Browdy and Neimark, P.L.L.C.

(57) ABSTRACT

A combination of tool kits is constructed to include a first tool kit having a holder base and a set of tool members installed in the holder base, a second tool kit having a holder base and a set of tool members installed in the holder base thereof, and a pair of magnetic attraction members. The magnetic attraction members are respectively mounted in the holder base of the first tool kit and the holder base of the second tool kit to provide magnetic attraction, thereby enabling the first tool kit and the second tool kit to be detachably fastened to each other by the force of the magnetic attraction.

7 Claims, 5 Drawing Sheets

COMBINATION OF TOOL KITS

FIELD OF THE INVENTION

The present invention relates generally to a combination of tool kits, and more particularly to such a combination of tool kits, which uses magnetic attraction to detachably secure two tool kits together.

BACKGROUND OF THE INVENTION

A bicycle tool kit is comprised of a set of tool members with different size or shape. In some bicycle repair works, one particular hand tool is used. In some other bicycle repair works (for example, tightening or loosening a screw bolt and a nut), two different hand tools should be used at the same time. Therefore, a combination of tool kits with various tool members is developed and is detachable easily when it is in use. Taiwan Utility Model No. 134699 discloses a magnetic attraction type combination of tool kits, which comprises a first tool kit and a second tool kit detachably fastened together. The first tool kit is provided with a recess and a retaining element disposed in the recess. The second tool kit is provided with a locating block. When attaching the locating block to the recess, the retaining element is forced into engagement with the locating block to secure the second tool kit to the first tool kit. When separating the tool kits, the user must disengage the retaining element from the locating block at first.

Taiwan patent publication No. 366864 discloses another design of magnetic attraction type combination of tool kits, which comprises a first tool kit having a coupling hole, and a second tool kit having a rotary retaining block. The rotary retaining block is fastened to the coupling hole through a rotary motion to secure the tool kits together. When fastening or separating the tool kits, the tool kits are kept in a particular direction, and then the rotary retaining block is rotated through an angle.

SUMMARY OF THE INVENTION

It is the main object of the present invention to provide a combination of tool kits, which enables two tool kits to be easily fastened to each other or detached from each other.

To achieve the above object, a combination of tool kits comprises a first tool kit having a holder base and a set of tool members respectively installed in the holder base, a second tool kit, the second tool kit comprising a holder base and a set of tool members respectively installed in the holder base, and a pair of magnetic attraction members respectively mounted in the holder base of the first tool kit and the holder base of the second tool kit to provide magnetic attraction, thereby enabling the first tool kit and the second tool kit to be detachably fastened to each other by the force of the magnetic attraction.

DETAILED DESCRIPTION OF THE INVENTION

Figure 1:
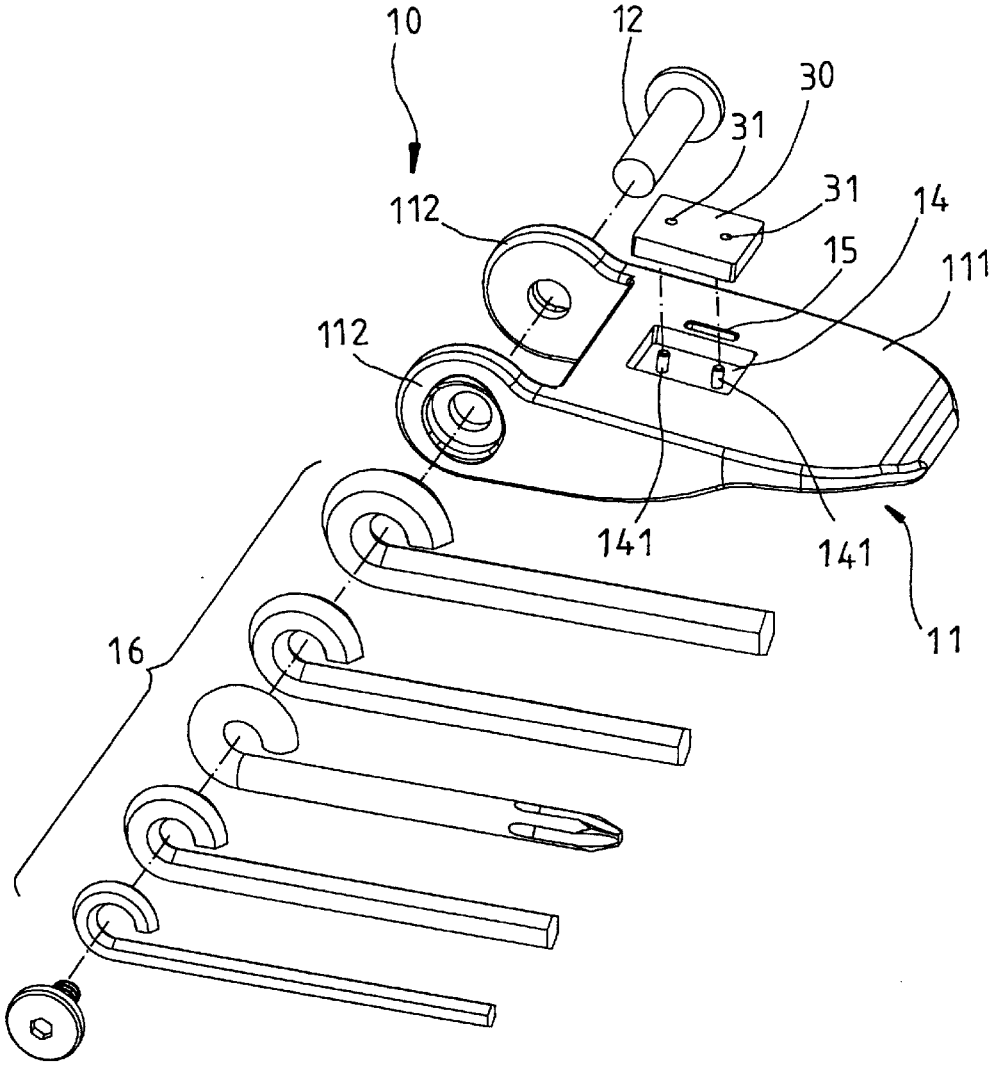
FIG. 1 is an exploded view of a first tool kit for the combination of tool kits according to a preferred embodiment of the present invention.
Figure 2:
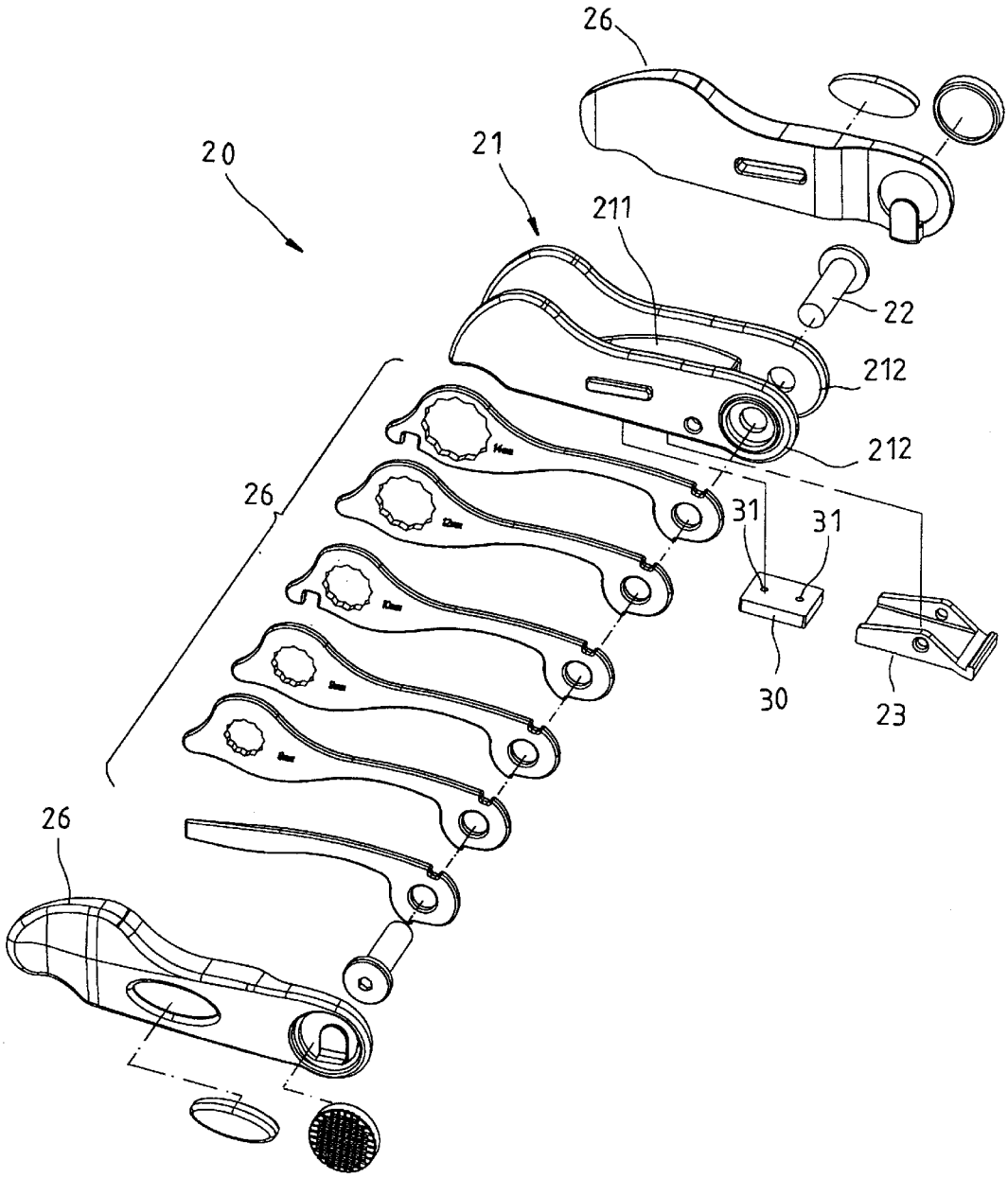
FIG. 2 is an exploded view of a second tool kit for the combination of tool kits according to the preferred embodiment of the present invention.
Figure 3:
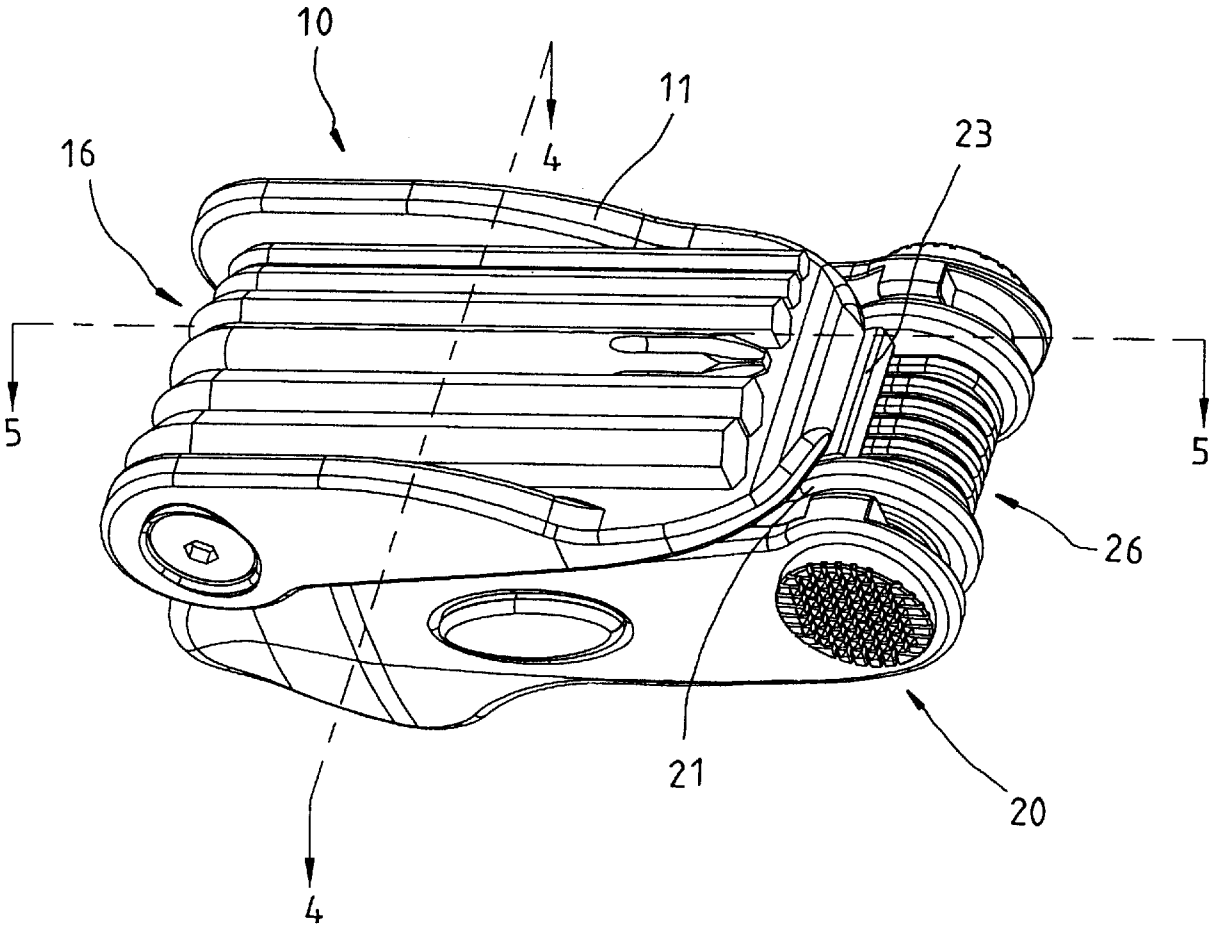
FIG. 3 is an elevational view of the preferred embodiment of the present invention.

Referring to FIGS. 1–3, a combination of tool kits according to a preferred embodiment of the present invention is shown comprised of a first tool kit 10 and a second tool kit 20.

Referring to FIG. 1 again, the first tool kit 10 is provided with a holder base 11 having a body 111 and two parallel lugs 112 bilaterally protruded from one side of the body 111, a set of tool members 16 including, for example, five hex wrenches of different sizes and a Phillips head tip screwdriver, and a pivot 12 fastened to the lugs 112 and one end of each of the tool members 16 to secure the tool members 16 to the holder base 11, for enabling the tool members 16 to be respectively turned about the pivot 12.

Referring to FIG. 2 again, the second tool kit 20 is provided with a holder base 21 having a body 211 and two parallel lugs 212 bilaterally protruded from one side of the body 211, a set of tool members 26 including, for example, five open-end wrenches of different sizes and two tire levers, a pivot 22 fastened to the lugs 212 and one end of each of the tool members 26 to secure the tool members 26 to the holder base 21 for enabling the tool members 26 to be respectively turned about the pivot 22, and a locating plate 23 fixedly fastened to the body 211 of the holder base 21 and adapted for supporting each of the tool members 26 in position when extended out.

The aforesaid arrangement is similar to a conventional combination of tool kits. The main features of the present invention are outlined hereinafter with reference to FIGS. 4 and 5 and FIGS. 1 and 2 again. The body 111 of the holder base 11 of the first tool kit 10 has a recessed portion 14, two upright mounting rods 141 disposed in the recessed portion 14, and a positioning slot 15 adjacent to one side of the recessed portion 14, as shown in FIG. 1. The body 211 of the holder base 21 of the second tool kit 20 has a recessed portion 24 corresponding in location to the recessed portion 14 of the body 111 of the holder base 11 of the first tool kit 10, two upright mounting rods 241 disposed in the recessed portion 24, and a protruded positioning block 25 corresponding in location to the positioning slot 15 of the body 111 of the holder base 11 of the first tool kit 10, as shown in FIGS. 4 and 5.

Figure 4:
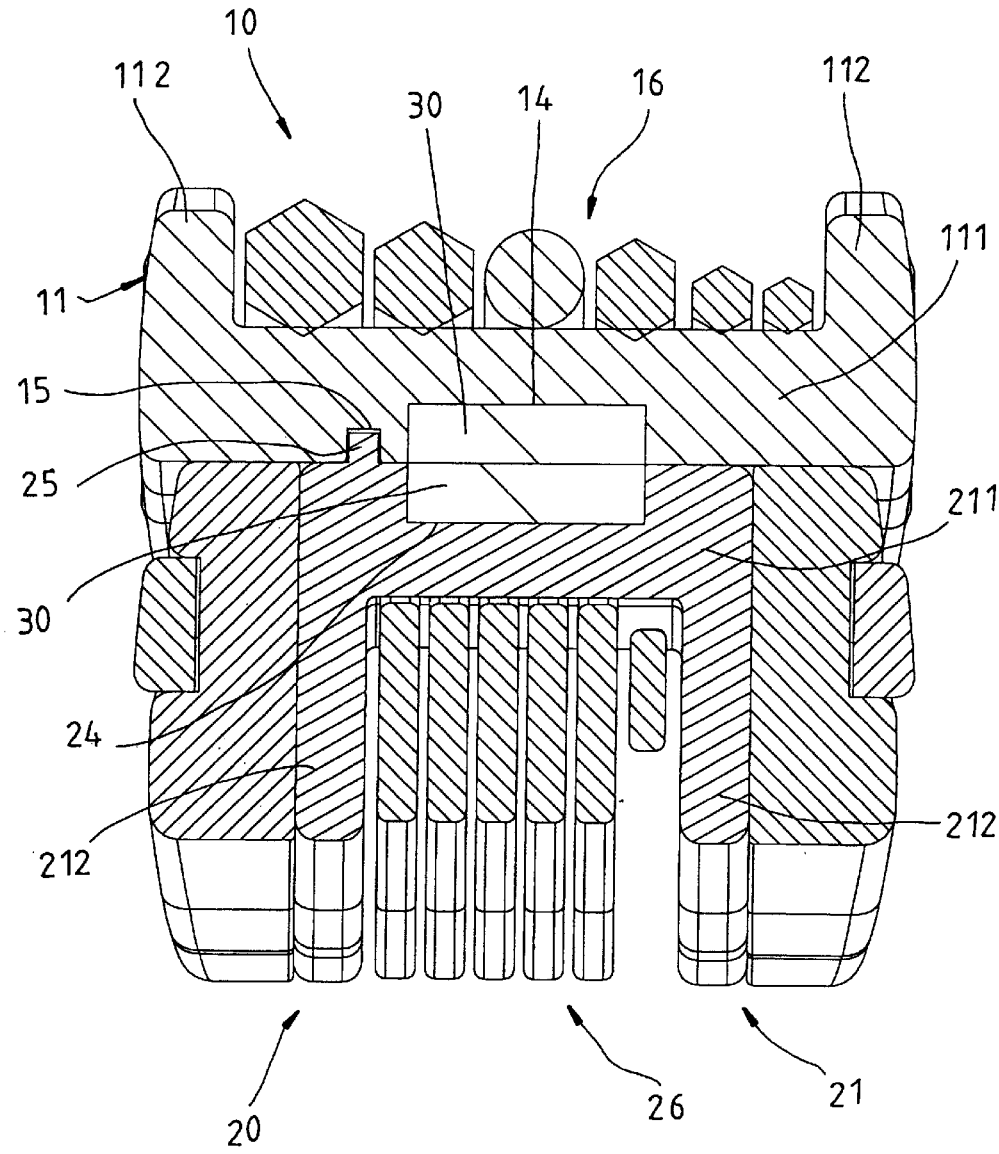
FIG. 4 is a sectional view taken along line 4—4 of FIG. 3.
Figure 5:
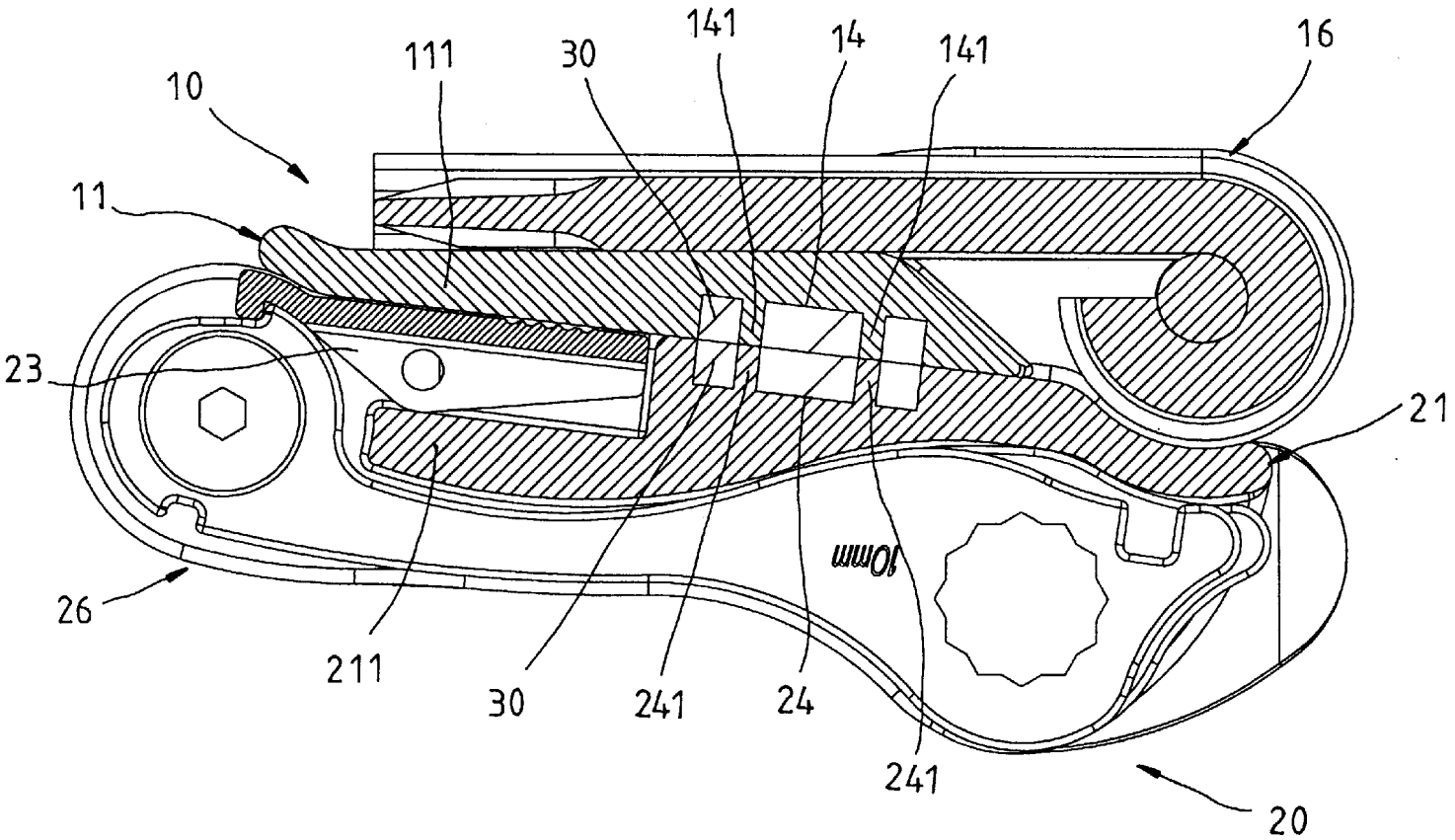
FIG. 5 is a sectional view taken along line 5—5 of FIG. 3.

Further, a pair of magnetic attraction members, for example, two magnets 30 are respectively mounted in the recessed portions 14 and 24 of the tool kits 10 and 20, each having two mounting holes 31, which receive the two upright mounting rods 141 or 241 of the corresponding tool kit 10 or 20, as shown in FIGS. 4 and 5. Alternatively, one magnet and one member, such as iron, to be attracted by the magnet may be used instead of two magnets.

When the magnetic members 30 are moved with the respective tool kits 10 and 20 toward each other, the magnetic members 30 attract each other, keeping the tool kits 10 and 20 secured together. At this time, the user can adjust the tool kits 10 and 20 to force the protruded block 25 of the second tool kit 20 into the positioning slot 15 of the first tool kit 10, as shown in FIG. 4. When separating the tool kits 10 and 20, pull the tool kits 10 and 20 in reversed directions with force.

What is claimed is:

1. A combination of tool kits, said combination comprising:

a first tool kit having a holder base and a set of tool members respectively installed in the holder base;

a second tool kit having a holder base and a set of tool members respectively installed in the holder base of said second tool kit;

a pair of magnetic attraction members respectively fastened to the holder base of said first tool kit and the holder base of said second tool kit to provide magnetic attraction for enabling said first tool kit and said second tool kit to be detachably fastened to each other by the force of magnetic attraction.

2. The combination of tool kits as claimed in claim 1, wherein the holder base of said first tool kit has a recessed portion for receiving one of the magnetic attraction members, and the holder base of said second tool kit has a recessed portion for receiving another magnetic attraction member.

3. The combination of tool kits as claimed in claim 2, wherein the holder base of said first tool kit is provided with at least one upright mounting rod disposed in the recessed portion of the first tool kit, and the magnetic attraction member received in the recessed portion of the first tool kit is provided with at least one mounting hole fastened to the at least one upright mounting rod of the holder base of said first tool kit.

4. The combination of tool kits as claimed in claim 2, wherein the holder base of said second tool kit is provided with at least one upright mounting rod disposed in the recessed portion of the second tool kit, and the magnetic attraction member received in the recessed portion of the second tool kit is provided with at least one mounting hole fastened to the at least one upright mounting rod of the holder base of said second tool kit.

5. The combination of tool kits as claimed in claim 1, wherein said magnetic attraction members are two magnets.

6. The combination of tool kits as claimed in claim 1, wherein one of said magnetic attraction members is a magnet, and another magnetic attraction member is the one to be attracted by said magnet.

7. The combination of tool kits as claimed in claim 1, wherein the holder base of said first tool kit is provided with a positioning slot, and the holder base of said second tool kit is provided with a protruded positioning block adapted for engaging into the positioning slot of said first tool kit.

* * * * *